United States Patent [19]

Cocks et al.

[11] Patent Number: 4,990,826

[45] Date of Patent: Feb. 5, 1991

[54] LOW VOLTAGE GAS DISCHARGE DEVICE

[76] Inventors: Franklin H. Cocks, 5 Learned Pla., Durham, N.C. 27705; Peter W. Farner, 3715 Lorraine, Kalamazoo, Mich. 49008

[21] Appl. No.: 428,109

[22] Filed: Oct. 27, 1989

[51] Int. Cl.[5] ..... H01J 61/067; H01J 61/32; H01J 61/42

[52] U.S. Cl. ..... 313/485; 313/491; 313/493; 313/515; 313/582; 313/621; 313/631; 313/634; 40/545

[58] Field of Search ..... 313/515, 493, 582, 621, 313/634, 485, 631, 491; 40/545

[56] References Cited

U.S. PATENT DOCUMENTS

| | | | |
|---|---|---|---|
| 4,504,766 | 3/1985 | Kaneko | 313/634 |
| 4,584,501 | 4/1986 | Cocks et al. | 313/493 |
| 4,703,574 | 11/1987 | Gurjian | 40/545 |
| 4,723,093 | 2/1989 | Nolan | 313/643 |
| 4,740,729 | 4/1988 | Chow | 313/493 |
| 4,786,841 | 11/1988 | Fohl et al. | 313/493 |
| 4,839,555 | 6/1989 | O'Mahoney | 313/634 X |

*Primary Examiner*—Palmer C. DeMeo

[57] ABSTRACT

This invention provides an illumination device capable of producing large animated displays using glowing neon or other noble gases without the need for a source of high voltage as is required in normal neon signs. By means of large numbers of electrode pairs, gas discharge across the gas passage rather than along the gas passage enables low voltages to excite the flowing gas discharge while still giving the appearance of the continuous discharge seen in normal neon signs. The use of mixtures of luminescent phosphors of different luminescent decay times allows the hue of the illumination device to be electrically controlled by means of the frequency with which the discharge is excited. The controlled, sequential activation of any given electrode pair further allows the illumination device to give the appearance of animation, and the use of front and rear mirrors enables an infinite series of multiple, animated, illuminated images to be displayed. The simultaneous use of controlled illumination sequence and illumination frequency allows the display to achieve the appearance of sequential, smoothly continuous waves of different color hues sweeping across an animated display.

12 Claims, 2 Drawing Sheets

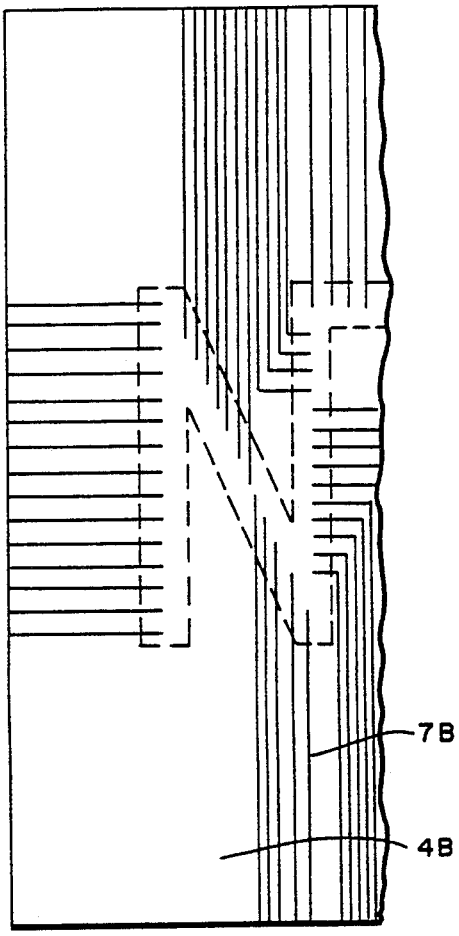
FIG. 3
FIG. 4
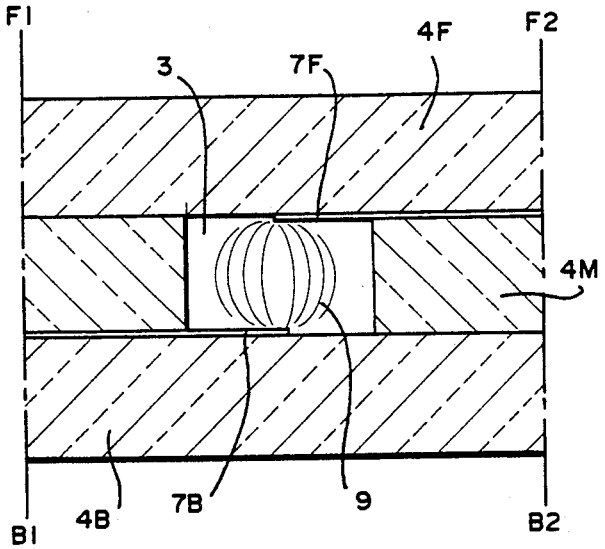
FIG. 5
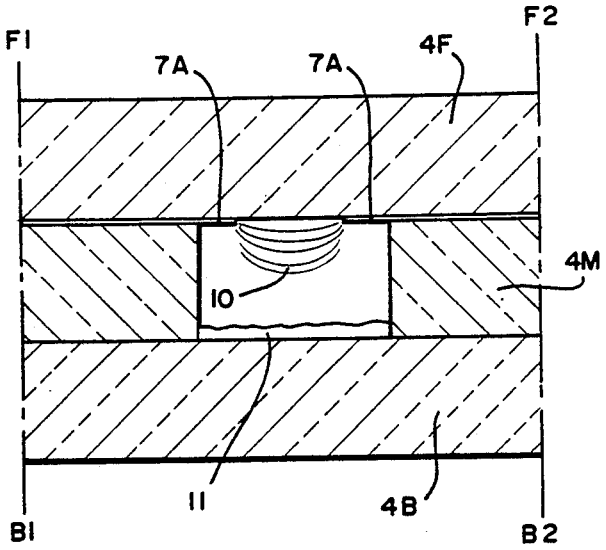

LOW VOLTAGE GAS DISCHARGE DEVICE

SUMMARY OF THE INVENTION

This invention provides a multifaceted lighting device comprising glass plates hermetically sealed together and provided with an interior channel or channels of any desired shape. The glass plates are transparent , but provision is made for the incorporation of opaque or translucent cover layers. Provision is also made for the evacuation and filling of the channel or channels with inert gas or inert gas/mercury vapor mixtures. Electrically conducting microscopic subminiature transplanar or coplanar electrodes in large numbers are configured so as to produce individually addressable closely spaced plasma discharge paths. Provision is also made for securing a vacuum tight seal between the plates as well as between each of the electrodes and the glass plates and also between the filling tube or tubes and the glass plates. The use of combinations of luminescent phosphors having different luminescent decay curves allows the hue and chromicity of the display to electrically controlled without the need for masking or the use of addressable phosphor deposits as is required in color-producing cathode ray tubes. Provision is also made for incorporating both front and rear reflecting surfaces, either or both of which may be semi-transparent such that an infinite number of multiple reflections of the luminous display are visibly produced. In the preferred embodiment, the overall effect of the invention is that of a neon sign which is made without the use of tubing for the gas discharge paths and which can produce an infinite series of displays of decreasing intensity and size, which can be simultaneously in motion or in repetitive illumination, and of electrically controllable hue, all without the need for the very high voltages customarily used in neon signs or the use of individually addressable phosphor deposits.

OBJECTS OF THE INVENTION

It is a particular object of the present invention to produce a neon sign of changeable color capable of being operated without the use of high voltage or high voltage transformers.

It is a further object of the present invention to produce a neon signa that can be operated directly from 120 volt AC or 240 volt supply mains without the need for a transformer.

It is yet another object of the present invention to provide a neon sign whose letters and symbols can be sequentially and controllably illuminated in a animated fashion.

It is still another object of the present invention to produce a gas discharge lighting device of greatly reduced weight and cost compared to other gas discharge display devices.

It is yet another object of the invention to produce a gas discharge lighting device whose hue and chromicity can be modulated and controlled at will without the need for individually addressable phosphor deposits.

BACKGROUND OF THE INVENTION

Many luminous point of purchase or other luminous display devices based upon the use of glowing electrical discharges through inert gases, especially neon, are known. Traditionally, such glow discharge paths have been formed within cylindrical channels produced using glass tubes that are bent to form the desired character shapes. The use of channels cut in a glass plate, said plate being then sealed using additional glass plates is also known, as described in U.S. Pat. No. 4,584,501, which also teaches the use of mirrors to produce multiple reflections of the luminous characters.

U.S. Pat. No. 4,703,574 teaches the use of cross-over bores in the back plate of three sandwiched plates hermetically sealed together and having a center plate aligned with said cross-over plates to define a legend which is made to glow by an electrical discharge through neon.

U.S. Pat. No. 4,786,841 teaches the use of three sealed envelopes phosphor coated with the primary colors red, green, and blue to produce a single picture element of electrically controllable color.

U.S. Pat. No. 4,740,729 teaches the construction of a plural color discharge lamp produced by using an outer discharge tube and an inner discharge tube each discharge tube utilizing a different phosphor to produce a light of a different color.

None of these patents however teach the use of an illumination device that can be operated without the use of a voltage above domestic line voltage. Furthermore, none of these earlier inventions utilize hundreds or even thousands of electrodes as is contemplated in the current invention. Indeed, most neon signs utilize only two or three electrodes per symbol that is to be illuminated. Furthermore, none of these patents teaches the use of mixtures of phosphors having different luminosity decay curves such that the hue and chromicity of the resultant light can be controlled by varying the flicker rate of the gas discharge.

Still other devices which utilize neon glow discharges are known and have been utilized for a variety of discharge panel applications. Such applications, however, have typically utilized the generation of charges, both ions and electrons, alternately storable at pairs of opposing discrete points or areas on a pair of dielectric surfaces backed by conductors to a voltage source as is taught by Nolan in U.S. Pat. No. 4,723,093. In this way it is possible to utilize addressable matrices of electrodes such that a truly vast number of illumination points is available. In such devices, however, the total illumination intensity is limited by the presence of the interposed dielectric layer and thus the luminescent intensity of the display produced is low and is not suitable for many advertising or other illumination purposes. Nolan does not teach the use of controlled mixtures of luminescent hosphors of different luminescent time decay curves to produce light of controllable hue and chromicity.

The following drawings illustrate how the objects of the present invention are to be accomplished.

BRIEF DESCRIPTION OF THE DRAWINGS

FIG. 3 is a plan view of plate (4B) of FIG. 2 with one electrode geometry revealed with reference to the letter N portion of the channel cut in plate (4M) of FIG. 2.

FIG. 4 is an enlarged view of the section indicated between lines F1–B1 and F2–B2 in FIG. 2 with one possible transparent electrode arrangement revealed.

FIG. 5 is an enlarged view of the section indicated between lines F1–B1 and F2–B2 in FIG. 2 with a second possible transparent electrode geometry revealed together with one arrangement of mixed luminescent phosphors.

DETAILED DESCRIPTION

Figure 1:
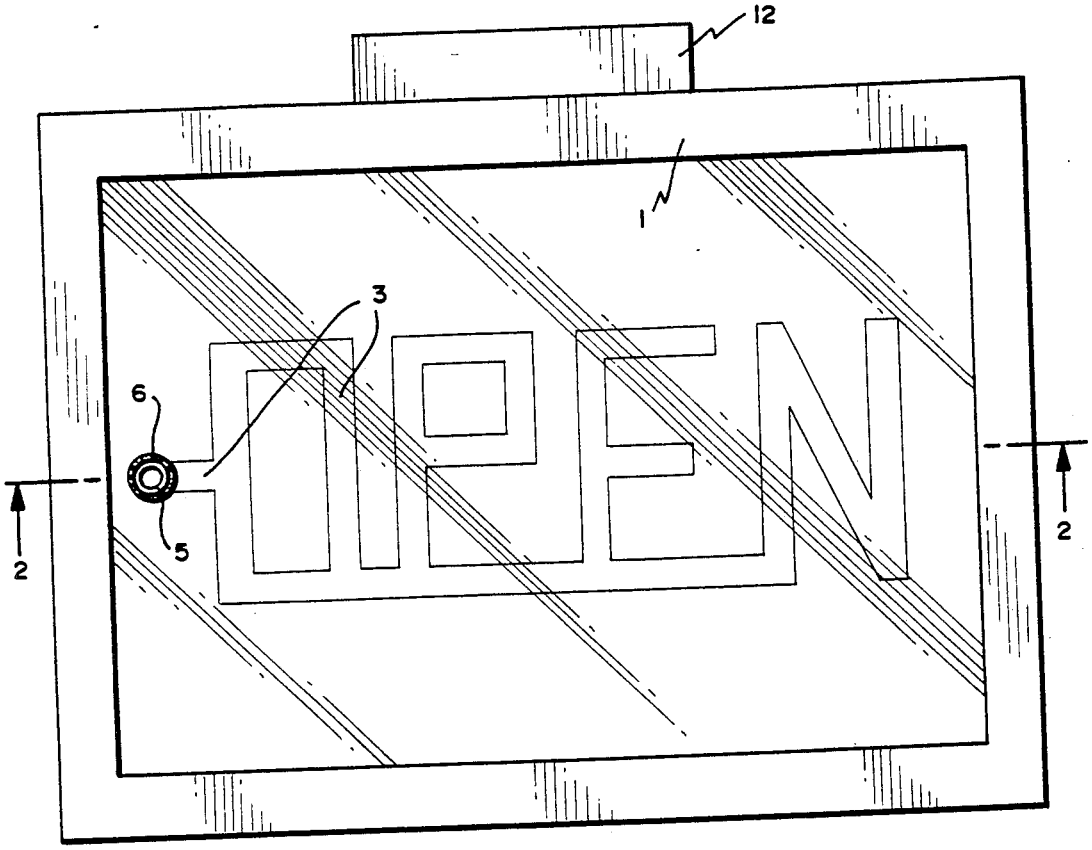
FIG. 1 is a front view of the device showing features of the preferred embodiments.
Figure 2:
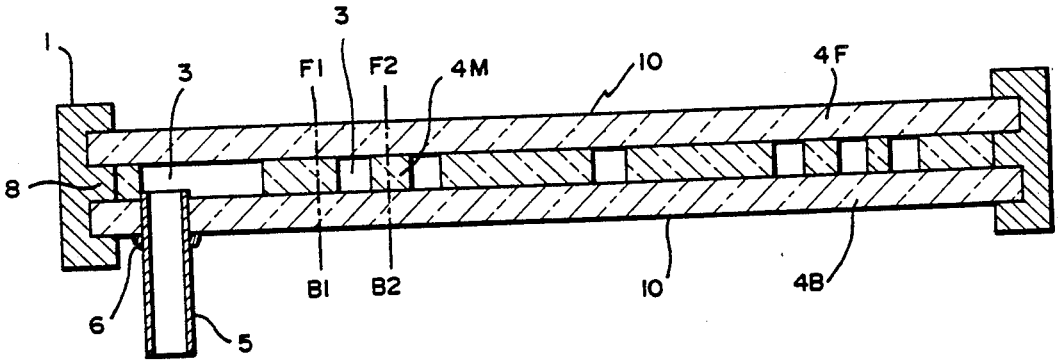
FIG. 2 is a sectional drawing taken along line 2—2 in FIG. 1.

Referring now to the figures, and in particualr to FIG. 1, there is seen a front view of the luminous device. Electrical power to the device is supplied by means of one or more edge connection strips (1) which in turn make connection through a large number of microscopic electrodes (7B) as shown in FIG. 3 to the gas channels (3). Said electrical power of controlled frequency and addressable to any specific electrode pair is supplied by a power supply unit (12) electrically connected to said connection strips (1). Said gas channels (3) in glass plate (4M) are covered on the front and back by glass plates (4F) and (4B), respectively, to form an enclosed volume for the gas discharge (9) as shown in FIG. 4 or the gas discharge (10) as shown in FIG. 5. These gas channels can be made vacuum tight by heating glass plates (4F), (4M), and (4B) after they have been placed in contact. Hermetic sealing at the tubulated evacuation and sealing port (5) shown in FIG. 2 can be accomplished by means of the use of glass frit (6) together with the softening and crimping of the tubulation port (5) itself. If fluorescent or phosphorescent materials are not used to coat an interior surface or surfaces of the channels, then the transplanar arrangement of the electrodes shown in FIG. 4 can be used, in which said electrodes lie on both plates (4F) and (4B). If, however, fluorescent materials are used to form a fluorescent layer (11) as shown in FIG. 5, then it will usually be preferable to confine the electrodes to plate (4F) so that the gas discharge (10) will be as shown in FIG. 5. In either arrangement, contact to the electrodes can be made by means of the protruding contact arms (8) which extend between plates (4F) and (4B) as shown in FIG. 2. The use of controlled mixtures of luminescent phosphors having different luminescent time decay rates in the fluorescent layer (11) enables the hue and chromicity of the display to be controlled in both time and position, without the need for individually addressable luminescent phosphor deposits, by controlling the flicker rate of the gas discharge. Thin, semitransoparent reflecting coatings (10) as shown in FIG. 2 can be used to provide multiple images of the display.

DESCRIPTION OF PREFERRED EMBODIMENTS

One preferred embodiment of this invention comprises a soda glass back plate (4B) which has been overlayed with an array of fine wires of an alloy composed substantially of 42 weight percent nickel and 58 weight percent iron, said alloy wires thus having a thermal expansion coefficient which nearly matches that of the soda glass, said overlay being arranged such that each individual electrode runs from at least one edge of said back plate and terminates at a point that lies within at least one channel cut into plate (4M). as shown in FIG. 5. Similarly, plate (4F) is a soda glass front plate which has also been coated with an array of fine wire electrodes that run from at least one edge and terminate at points which lie within channel cut within plate (3). The soda glass back plate (4B) is provided with a tubulated access port for the purpose of evacuating and backfilling, said tubulated access port being hermetically sealed to the soda glass plate (4B) by means of Corning type 7575 or other glass frit. After evacuation and sealing said tubulated evacuation port is itself then sealed by being heated until the tubulation is soft and then pinching. If the fill gas is neon, and the preferred gas pressure range is between 1 and 20 millitorr, then it is found that the application of 120 volts of AC or DC electric potential between electrodes 7A and 7B will cause the neon to go nto a glowing discharge, provided that the thickness of the glass plate (4M) is less than about $\frac{5}{8}$ inches. It has been discovered that the gas glow discharge is always wider than the thin electrode, and thus, by making the individual electrodes very narrow and by spacing them closely the glow discharge produced by each pair of electrodes will overlap with the glow discharge produced by the neighboring pair of electrodes such that the channels which form the individual characters will be substantially filled by the glow discharge. To animate the individual characters, it is necessary to sequentially apply voltage to each pair of electrodes, as for example the pair (7F)–(7B) shown in FIG. 4. Such sequential application of voltage may be accomplished by electronic, mechanical, or manual methods and is made relatively straightforward by the fact that the magnitude of the voltage, as well as the magnitude of the current that is to be applied is small. For example, an electrode pair will typically need to supply less than 50 milliamperes of current at 120 volts, and this low level of power, approximately five watts, can easily be switched by solid state electronic means. Contact from the voltage source to the electrodes is accomplished by means of the edge connection strip (1). By sequential application of voltage to the electrode pairs, leap-frogging or other simulated animation effects can readily be produced in a manner that is not possible with normal neon signs. If animation of the illuminated display device is not required, then all electroded pairs can simply be powered simultaneously by the application of voltage to the entire array of electrodes contained on the front plate (7F) and on the botton plate (7B). In general it may be desired that the power delivered to each electrode pair be nearly the same. Such equalization of power may be achieved either by means of electrodes of nearly uniform resistivity, but varying resistance together with with trimming resistors to compensate for the differences in electrode lengths.

In a second preferred embodiment of this invention, the electrodes, rather than being metal wires are instead optically transparent coating stripes substantially of tin oxide or indium oxide applied to the surfaces of glass plates (4A) and (4B) by spraying, painting, vacuum coating sputtering, or other suitable means. In this embodiment, equilization of the power supplied to each electrode pair can be achieved either by making the electrodes of nearly uniform width and thickness together with the use of trimming resistors to compensate for the differences in electrode lengths, or we have found that equalization of total delivered power to every electrode pair may also be accomplished by maintaining constant the value of the total length divided by the width lines thickness of every electrode pair. That is, the electrode pairs that are short need also to be narrow, and those electrode pairs that are long need also to be wide. In this way we have discovered that the illumination intensity may be economically and simply maintained nearly constant. In general it is found most practical to maintain the thicknesses of the electrodes essentially constant, although conceptually this is not required provided that the valve of the total length divided by the width times thickness of every electrode pair is maintained essentially constant.

Still another preferred embodiment of this invention encompasses the use of phosphors applied on a portion of the channel (3) as shown in FIG. 5. In this case the filling gas preferably contains mercury and argon and the electrode pairs are confined to the front plate (7F). In this coplanar electrode embodiment it has been found that the maximum total power delivered to each electrode pair may be reduced below the maximum that can be applied in the case of the transplanar electrode arrangement because the confinement of the glow discharge to one side of the discharge channel gives rise to local heating effects which are not experienced in the case of the transplanar arrangement. The use of phosphors, however, allows the sign to exhibit a wide range of colors which are not achievable without the use of luminescent phospors. We have now found that if phosphors having different luminescent decay curves are mixed together and applied, then the observed hue and chromaticity of the resulting display will depend upon the frequency with which the gas discharge is activated and deactivated. We have found, for example that if Sylvania phosphor number 930, which emits red light and has a time decay constant of longer than one minute, is mixed with Voltarc phosphor 6500, which emits white light and has a time decay constant of less than about one tenth of a second, then when the frequency of activation of the mercury/argon discharge is slower than about one cycle every three tenths of a second, the hue of the visible color is red, but when the frequency of the activation of the mercury/argon discharge is faster than one cycle every five hundredths of a second, the hue of the viewed display is nearly white and only faintly rose. It will be appreciated that a large number of other hue and charomaticity combinations can be produced, especially if more than two phosphors all of different luminescent decay times are mixed together.

We claim:

1. A gas-discharge device which comprises a glass into which is cut at least one channel, said channel being provided with evacuation and gas filling means and hermetically sealed to both front and back glass plates, said channel being also provided with a plurality of electrode pairs such that a voltage can be applied across the the channel to cause a glow discharge to occur, said glow discharge being visible through at least one of the front and back plates.

2. A gas-discharge device as described in claim 1 wherein the applied voltage is approximately normal line voltage.

3. A gas-discharge device as described in claim 1 wherein the plurality of electrode pairs are transparent conducting films, said films all being substantially the same width.

4. A gas discharge device as described in claim 1, wherein the electrode pairs are comprised of transparent conducting films, said films being of different widths and lengths but substantially the same thickness such that the value of the total length divided by the width times thickness of every electrode pair is substantially constant.

5. A gas-discharge device as described in claim 1 wherein the electrode pairs are comprised of metal conductors.

6. A gas-discharge device which comprises a glass plate into which is cut at least one channel, said channel being provided with evacuation and gas filing means and hermetically sealed to both front and back glass plates, said channel being provided with a plurality of electrode pairs such that a voltage can be applied across the the channel to cause a glow discharge to occur across this channel, said channel being also provided with a phosphor coating, said phosphor coating containing a mixture of at least two phosphors each of which has a different luminescent decay curve, said electrode pairs additionally being individually addressable such that a voltage can be individually applied to each electrode pair to cause that pair of electrodes to produce a cycle glow discharge which, in combination with said phosphor coating, produces an animated luminescent display whose hue and chromaticity depend on the frequency of said cyclic glow discharge.

7. A gas-discharge device as described in claim 6 wherein the voltage that is applied to each electrode pair is approximately normal line voltage.

8. A gas discharge device as described in claim 6 wherein the electrode pairs are composed of transparent conducting films all of substantially the same width and thickness.

9. A gas discharge device as described in claim 6 wherein the electrode pairs are of different widths and lengths but substantially the same thickness such that the valve of the total length divided by the width times thickness of every electrode pair is substantially constant.

10. A gas-discharge device which comprises a glass plate into which is cut at least one channel, said channel being provided with evacuation and gas filling means and hermetically sealed to both front and back glass plates, said channel being provided with a plurality of electrode pairs such that a voltage can be applied across the channel, said channel being also provided with a phosphor coating, said phosphor coating containing a mixture of two or more phosphors, each of which has a different luminescent decay curve, said electrode pairs being all activated substantially simultaneously to produce a display whose hue and chromaticity depend on the frequency of said cyclic glow discharge.

11. A gas discharge device as described in claim 8 wherein the voltage that is applied to the electrode pairs is approximately normal line voltage.

12. A gas discharge device as described in claim 10 wherein the plurality of electrode pairs are composed of transparent conducting films, said films being of different widths and lengths but substantially the same thickness such that the value of the total length divided by the width times thickness of every electrode pair is substantially constant.

* * * * *